US009022252B2

(12) United States Patent
Beggins et al.

(10) Patent No.: US 9,022,252 B2
(45) Date of Patent: May 5, 2015

(54) INSULATING HOLDER WITH ELASTOMER FOAM MATERIAL

(76) Inventors: Thomas M. Beggins, San Juan Capistrano, CA (US); Jeffrey J. Beggins, Redington Beach, FL (US)

( * ) Notice: Subject to any disclaimer, the term of this patent is extended or adjusted under 35 U.S.C. 154(b) by 247 days.

(21) Appl. No.: 13/586,695

(22) Filed: Aug. 15, 2012

(65) Prior Publication Data

US 2013/0240549 A1 Sep. 19, 2013

Related U.S. Application Data

(60) Provisional application No. 61/610,336, filed on Mar. 13, 2012.

(51) Int. Cl.

| | |
|---|---|
| ***B65D 25/00*** | (2006.01) |
| ***B65D 6/40*** | (2006.01) |
| ***B65D 23/12*** | (2006.01) |
| ***B65D 21/08*** | (2006.01) |
| ***B65D 81/38*** | (2006.01) |

(52) U.S. Cl.

CPC ..... *B65D 21/086* (2013.01); *B65D 81/3879* (2013.01)

(58) Field of Classification Search

CPC ..... B65D 81/3879; Y10S 220/902; Y10S 220/903; B60N 3/106; B60N 3/108

USPC ..... 220/739, 737, 902, 903; D7/619.1; 215/393, 395; 248/311.2

See application file for complete search history.

(56) References Cited

U.S. PATENT DOCUMENTS

| | | | | |
|---|---|---|---|---|
| 3,779,298 | A * | 12/1973 | Piccirilli et al. | 220/4.21 |
| 4,534,391 | A * | 8/1985 | Ventimiglia et al. | 220/739 |
| 4,681,239 | A * | 7/1987 | Manns et al. | 220/592.16 |
| 5,277,733 | A * | 1/1994 | Effertz | 156/215 |
| 5,390,804 | A * | 2/1995 | Beggins | 215/386 |
| 6,039,206 | A * | 3/2000 | DeFrancesco | 220/737 |
| 6,554,155 | B1 | 4/2003 | Beggins | |
| 6,604,649 | B1 * | 8/2003 | Campi | 220/739 |
| 7,201,285 | B2 * | 4/2007 | Beggins | 215/386 |
| 7,614,516 | B2 | 11/2009 | Beggins | |
| D663,169 | S | 7/2012 | Beggins | |
| 2002/0113072 | A1 | 8/2002 | Lane | |
| 2006/0091143 | A1 | 5/2006 | Chantalat | |
| 2007/0199935 | A1 | 8/2007 | Beggins | |

FOREIGN PATENT DOCUMENTS

| | | | |
|---|---|---|---|
| EP | 1526094 | A1 * | 4/2005 |
| WO | 2005/028317 | | 3/2005 |

OTHER PUBLICATIONS

International Search Report for PCT/US2013/030899, completion date: Jun. 25, 2013; 5 pages.

Written Opinion for PCT/US2013/030899, completion date: Jun. 25, 2013; 10 pages.

* cited by examiner

*Primary Examiner* — Robert J Hicks
*Assistant Examiner* — Shawn M Braden

(57) ABSTRACT

An insulating holder for holding a beverage in a bottle or a can having a lower cylindrical enclosure which receives an upper cylindrical enclosure having a dome-shaped upper end. The upper cylindrical enclosure is adapted to cover the top portion of a bottle inserted into the lower cylindrical enclosure and to snuggly receive a can when inverted and inserted into the lower cylindrical enclosure. At least a portion of the lower cylindrical enclosure or upper cylindrical enclosure is made of a polyolefin elastomer foam. The insulating holder may be structured to retain various sizes of wine bottles.

14 Claims, 14 Drawing Sheets

INSULATING HOLDER WITH ELASTOMER FOAM MATERIAL

This application claims the benefit of U.S. Provisional Application No. 61/610,336, filed Mar. 13, 2012, the entire contents of which is hereby incorporated by reference.

BACKGROUND OF THE INVENTION

1. Field of the Invention

The present invention relates to improvements in holders for maintaining cold containerized liquids in a cool state and more particularly pertains to a new and improved lightweight portable holder for either a bottle or a can.

2. Description of Related Art

A number of structures for insulating containers have been proposed in the prior art. Perhaps the most familiar structure is the cylindrical foam jacket or sleeve conventionally used to cool standard cylindrical cans containing beer, soda and the like. Such devices are typically inadequate and only partially effective when it comes to a bottle. Other structures exhibit practical drawbacks in that they leave the bottle contents partially exposed or employ cumbersome attachment mechanisms such as mechanical clasps or snaps.

Applicant's U.S. Pat. No. 5,390,804 discloses a bottle insulating device having a lower cylindrical enclosure which telescopically receives an upper cylindrical enclosure having a dome-shaped upper end and an opening therein of a diameter selected to determine the extent to which the upper cylindrical enclosure slides down the bottle neck and, hence, the extent to which the upper cylindrical enclosure extends into the lower cylindrical enclosure.

Applicant's U.S. Pat. No. 6,554,155 discloses an insulating device for bottles having a lower cylindrical enclosure which telescopically receives an upper cylindrical enclosure having a dome-shaped upper end, the upper and lower cylindrical enclosures being provided with mating threads adapted to achieve a plunge insertion and sealing feature.

Applicant's U.S. Pat. No. 7,201,285 discloses an insulating device for bottles having a lower cylindrical enclosure which telescopically receives an upper cylindrical enclosure having a dome-shaped upper end, the upper cylindrical enclosure having shims to retain a bottle or can contained therein.

Applicant's U.S. Pat. No. 7,614,516 discloses an insulating device for bottles having a lower cylindrical enclosure which telescopically receives an upper cylindrical enclosure having a dome-shaped upper end, the lower cylindrical enclosure including vertical ribs to retain the upper cylindrical enclosure therein.

While these structures exhibit advantages over other prior art cooler devices, it has become apparent to applicant that further improvements could provide even a more useful and effective cooler apparatus, especially in the provision of a single apparatus that can accommodate both a bottle and a can which can easily be used.

SUMMARY OF THE INVENTION

An insulating holder having a lower cylindrical enclosure receives an upper cylindrical enclosure which has a dome-shaped upper end. The upper and lower cylindrical enclosures fit together by the upper cylindrical enclosure sliding into the lower cylindrical enclosure. The upper cylindrical enclosure is adapted to cover the top portion of a bottle inserted into the lower cylindrical enclosure and to snuggly receive a can when inverted and inserted into the lower cylindrical enclosure. At least a portion of the upper cylindrical enclosure or the lower cylindrical enclosure is made of a polyolefin elastomer foam. Polyolefin elastomer foam provides unexpected superior performance for the shape of the insulating holder disclosed in this application. Such unexpected performance includes improved insulation for the insulating holder, improved aerodynamic properties for the insulating holder, and improved impact protection for a bottle contained within the insulating holder.

In an embodiment, the insulating holder is structured to retain a wine bottle. The insulating holder is dimensioned to accommodate multiple sizes of wine bottles within the same holder.

BRIEF DESCRIPTION OF THE DRAWINGS

The exact nature of this invention, as well as the objects and advantages thereof, will become readily apparent from consideration of the following specification in conjunction with the accompanying drawings in which like references numerals designate like parts throughout the figures thereof and wherein.

DETAILED DESCRIPTION OF THE PREFERRED EMBODIMENTS

Reference will now be made in detail to the preferred embodiments of the invention which set forth the best modes contemplated to carry out the invention, examples of which are illustrated in the accompanying drawings. While the invention will be described in conjunction with the preferred embodiments, it will be understood that they are not intended to limit the invention to these embodiments. On the contrary, the invention is intended to cover alternatives, modifications and equivalents, which may be included within the spirit and scope of the invention as defined by the appended claims.

Furthermore, in the following detailed description of the present invention, numerous specific details are set forth in order to provide a thorough understanding of the present invention. However, it will be obvious to one of ordinary skill in the art that the present invention may be practiced without these specific details. In other instances, well known methods, procedures, and components have not been described in detail as not to unnecessarily obscure aspects of the present invention.

Figure 1:
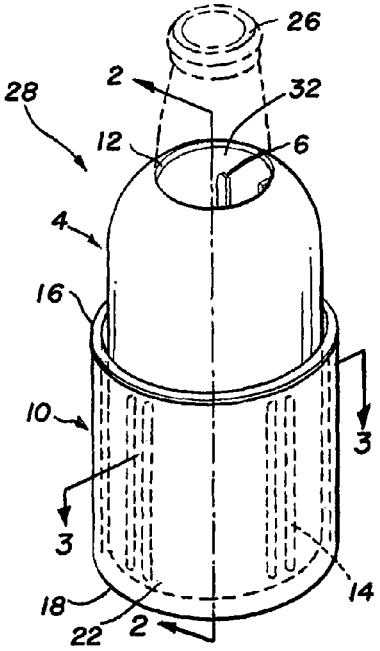
FIG. 1 is a perspective view of an embodiment of the present invention.

FIG. 1 illustrates an insulating holder 28 of an embodiment, which includes a lower cylindrical enclosure 10 and an upper cylindrical enclosure 4. Both the upper cylindrical enclosure 4 and lower cylindrical enclosure 10 are shown installed about a bottle 26 (in phantom). The bottle 26 is generally formed to have a side and a neck, in which the neck generally increases in diameter from the top capped part to the shoulder area (not shown).

To hold the bottle 26, the lower cylindrical enclosure 10 can have a depth sized to receive at least one-fourth of the length of the bottle 26. The general shape of the upper and lower cylindrical enclosures 4 and 10, respectively, are more completely described in applicant's U.S. Pat. Nos. 5,390,804, 6,554,155, 7,201,285 and 7,614,516, the disclosures of which are each incorporated herein by reference.

Figure 2:
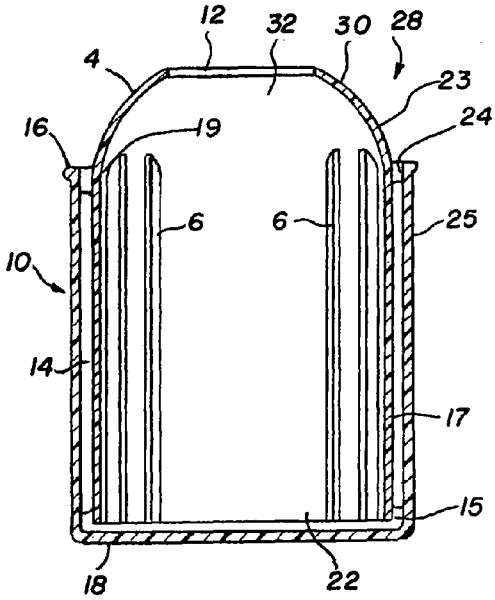
FIG. 2 is a cross-sectional view of FIG. 1 taken along line 2-2.

Referring to FIGS. 1 and 2, the upper cylindrical enclosure 4 has a dome-shaped first end 30, a second circular rim end 22, a circular opening 12, and an interior wall 32. The diameter of the circular opening 12 is less than the diameter of the second circular rim end 22. A plurality of shims 6 are located on the interior wall 32. The upper cylindrical enclosure 4 is shaped to be slid into the lower cylindrical enclosure 10.

The lower cylindrical enclosure 10 comprises a top portion 16 and a bottom portion 18. The lower cylindrical enclosure 10 has a plurality of vertical ribs 14 on an interior wall of the lower cylindrical enclosure 10 to frictionally grip and form a friction fit the upper cylindrical enclosure 4. While FIG. 1 depicts a plurality of vertical ribs 14, it is contemplated, however, that utilizing only one vertical rib may be sufficient to frictionally grip the upper cylindrical enclosure 4.

As shown in FIGS. 1 and 2, a plurality of shims 6 are located on the interior wall 32 of the upper cylindrical enclosure 4. As more clearly shown in FIG. 3, the shims 6 are integral with the interior wall 32 of the upper cylindrical enclosure 4. Each shim is constructed in the form of an open blister. The dimensions of the upper cylindrical enclosure 4 and the shims 6 therein are such that a variety of bottle sizes can be accommodated by the upper cylindrical enclosure 4 when it inserts into the lower cylindrical enclosure 10.

Figure 14:
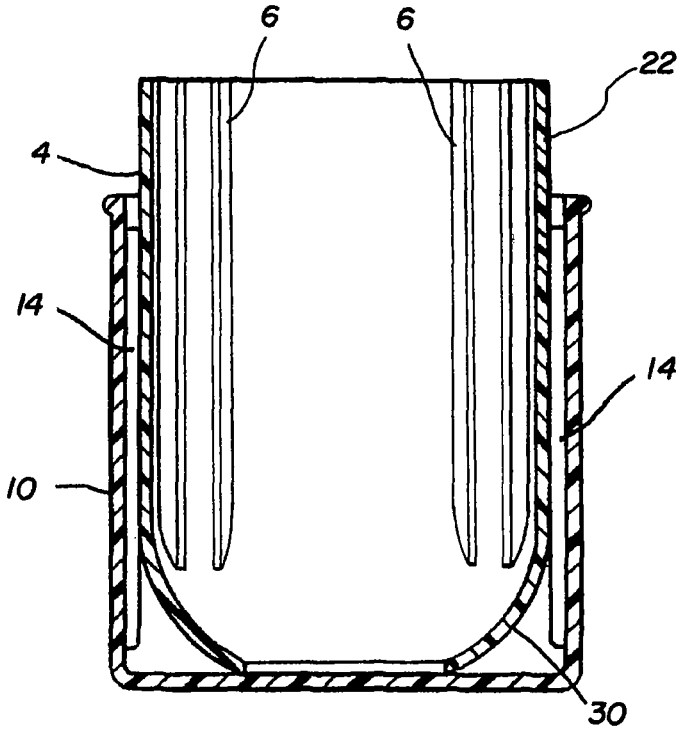
FIG. 14 is a cross-sectional view of the combination bottle and can cooler shown with an upper cylindrical enclosure inverted within a lower cylindrical enclosure.

Also shown in FIGS. 1 and 2, the vertical ribs 14 located on the interior wall 24 of the lower cylindrical enclosure 10 are constructed such that the upper cylindrical enclosure 4 can be inserted into the lower cylindrical enclosure 10 with the second circular rim end 22 of the upper cylindrical enclosure 4 going into the lower cylindrical enclosure 10 first, as shown in FIG. 1, or with the dome-shaped end 30 of the upper cylindrical enclosure 4 going into the lower cylindrical enclosure 10 first as shown in FIG. 14.

By this construction, the insulating holder 28 can be used to hold the bottle 26 by the upper cylindrical enclosure 4 being an invertible cylindrical enclosure 4. Namely, the upper cylindrical enclosure 4 may be inserted into the lower cylindrical enclosure 10 in one direction as seen in FIG. 1 and may hold a can by reversing the direction of insertion of the upper cylindrical enclosure 4 into the lower cylindrical enclosure 10 as shown in FIG. 14. As shown in FIGS. 1 and 2, when the upper cylindrical enclosure 4 is inserted into the lower cylindrical enclosure 10 with the second circular rim end 22 inserted first, then all portions of the rigid bottle 26 from the shoulder down are enclosed by the upper cylindrical enclosure 4 and lower cylindrical enclosure 10.

The insulating holder 28 is preferably made of a polyolefin elastomer foam. The polyolefin elastomer used may include the copolymers of either ethylene-butene or ethylene-octene, including low density poly(ethelene-co-ocene) and (polyethelene-co-butene). Other materials for polyolefin foam manufacture include the homo and copolymers of ethylene and propylene. In other embodiments, other polyolefin elastomers may be used as desired. The polyolefin elastomer foam is preferably made through a molding process using a chemical blowing agent, which results in a closed cell foam with a skinned outer surface. In other embodiments, other methods of making a polyolefin elastomer foam may be used as desired.

Polyolefin elastomer foam is particularly well suited for manufacture of the insulating holder 28 shown in FIG. 1, and the other insulating holders disclosed throughout this application. Polyolefin elastomer foam provides unexpected superior benefits for the insulating holders disclosed in this application. One such unexpected benefit includes improved insulation based on the retention of liquids between polyolefin elastomer foam wall surfaces. Another unexpected benefit includes improved aerodynamic properties for the shape of the insulating holder disclosed in this application.

The use of polyolefin elastomer foam unexpectedly improves insulation of the insulating holder, because liquid is more easily trapped between the wall surfaces of the insulating holder. FIG. 2 for example, illustrates the narrow space 15 between the outer wall 17 of the upper cylindrical enclosure 4 and the interior wall 24 of the lower cylindrical enclosure 10. Condensation forming around a beverage bottle 26 contained within the insulating holder 28 must travel through this narrow space 15 to exit from the holder 28, which will consequently heat the beverage bottle 26. However, a polyolefin elastomer foam material beneficially causes a tight fit between the outer wall 17 of the upper cylindrical enclosure 4 and the interior wall 24 of the lower cylindrical enclosure 10, to reduce the ability of fluid to exit this narrow space 15. It is therefore more difficult for condensation to exit, which keeps the retained bottle colder for longer.

Figure 31:
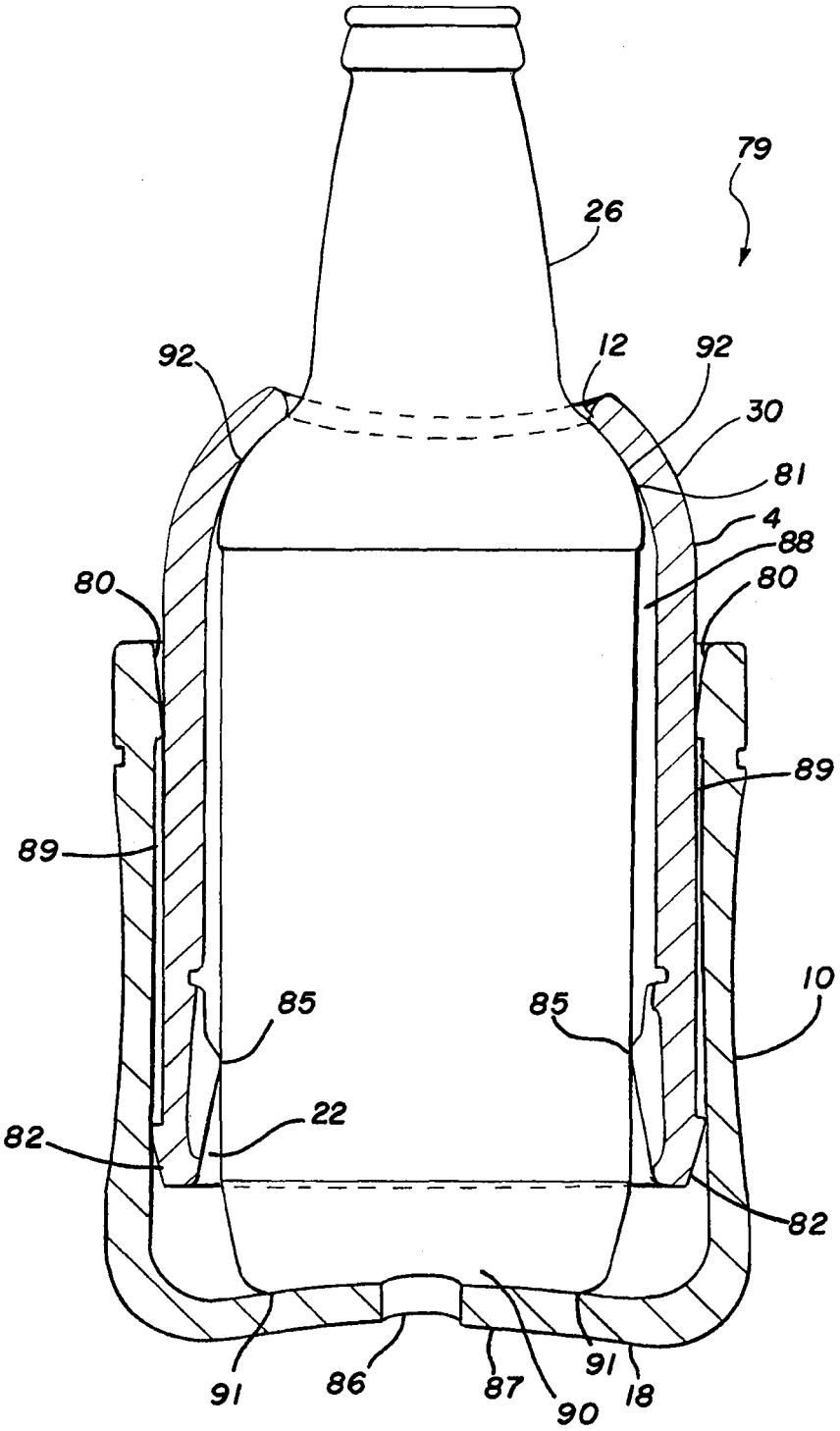
FIG. 31 is a cross-sectional view of the embodiment shown in FIG. 28, with the upper cylindrical enclosure inserted into the lower cylindrical enclosure.

Similar benefits are observed around the shoulder 81 of the bottle 26, shown in FIG. 31, for example. A polyolefin elastomer foam material beneficially creates a tight seal between the shoulder 81 of the bottle 26 and the circular opening 12 of the upper cylindrical enclosure 4, thereby making it more difficult for the condensation to exit, and keeping the bottle 26 cooler for longer. The tight seal formed by the polyolefin elastomer foam also aids formation of tight seals of air pockets 88, 89, 90, 94 shown in FIGS. 31 and 32. The air pockets 88, 89, 90, 94 improve the insulating properties of the holders disclosed throughout this application.

In addition, the polyolefin elastomer foam material is water resistant, which prevents the condensation from leaking through one of the walls 17, 24, shown in FIG. 2 for example. Such benefits are observed over other kinds of foam, including Styrofoam for example, which does not form a tight seal and will absorb condensation over time. The tight seals formed by the polyolefin elastomer foam, and water resistance of the foam, also prevent condensation from pouring onto the user when the user tilts the insulating holder to drink a beverage.

The use of polyolefin elastomer foam also unexpectedly results in improved aerodynamic properties for the shape of the insulating holder disclosed in this application. If the insulating holder 28 in the configuration shown in FIG. 1, for example, were viewed without a bottle 26 therein, it would have a bullet-like shape. The aerodynamic properties of the bullet-like shape are aided by the smooth skinned outer surface of a polyolefin elastomer foam, which reduces air resistance. Thus, the insulating holder 28 may be thrown like a football in a tight spiral. Such unexpected results improve the marketability of the insulating holder 28 to a consumer interested in a football tailgating toy.

Other unexpected benefits associated with the use of a polyolefin elastomer foam include improved overall thermal insulation for the shape of the insulating holder disclosed in this application, and improved impact protection for a bottle contained within the insulating holder of a shape disclosed in this application.

A polyolefin elastomer foam may be used with any part of portion of an insulating holder disclosed in this application, to provide benefits disclosed in this application. At least a portion of the upper cylindrical enclosure 4 or the lower cylindrical enclosure 10 may be made of the polyolefin elastomer foam or any other material otherwise including a polyolefin elastomer foam. In one embodiment, the interior walls 19, 24 of the upper cylindrical enclosure 4 and lower cylindrical enclosure 10 may be made of a polyolefin elastomer foam. In one embodiment, the outer walls 23, 25 of the upper cylindrical enclosure 4 and lower cylindrical enclosure 10 may be made of a polyolefin elastomer foam. In one embodiment, all portions of the upper cylindrical enclosure 4 or the lower cylindrical enclosure 10 covering the bottle 26 may be made of a polyolefin elastomer foam. In one embodiment, all portions of the upper cylindrical enclosure 4 and lower cylindrical enclosure 10 may be made of a polyolefin elastomer foam.

FIG. 2 is a cross-section of FIG. 1 taken along a line 2-2. As can be seen, the plurality of vertical ribs 14 are preferably elongated and protrude slightly from an interior wall 24 of the lower cylindrical enclosure 10 such that the upper cylindrical enclosure 4 is snuggly fit into the lower cylindrical enclosure 10. This allows the plurality of vertical ribs 14 to frictionally grip the upper cylindrical enclosure 4. Thus, when the insulating holder 28 is tilted at an angle, upper cylindrical enclosure 4 will remain substantially in place or will exit lower cylindrical enclosure 10 at a reduced speed. This allows a user to drink the contents of the bottle 26 or a can without worrying about the upper cylindrical enclosure 4 and the bottle 26 or can falling out of the lower cylindrical enclosure 10.

Figure 3:
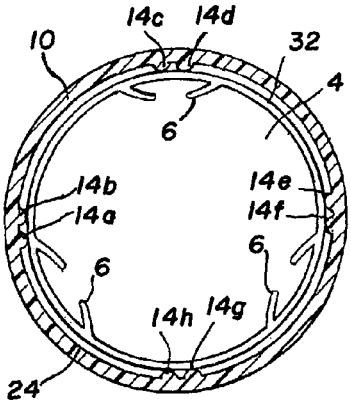
FIG. 3 is a cross-sectional view of FIG. 1 taken along line 3-3.

FIG. 3 is a cross-section of FIG. 1 taken along a line 3-3. As seen in FIG. 3, the vertical ribs 14*a-h* can be arranged in pairs on the interior wall 24 of the lower cylindrical enclosure 10. Each pair of vertical ribs is comprised of a first vertical rib and a second vertical rib such that the distance between the first vertical rib and the second vertical rib can be less than the distance between the first vertical rib and any other plurality of vertical ribs and can also be less than the distance between the second vertical rib and any other plurality of vertical ribs. For example, vertical ribs 14*a* and 14*b*, 14*c* and 14*d*, 14*e* and 14*f*, and 14*g* and 14*h*, form four pairs of vertical ribs. Furthermore, each pair of vertical ribs can be substantially evenly spaced out on the interior wall 24 of the lower cylindrical enclosure 10.

Figure 4:
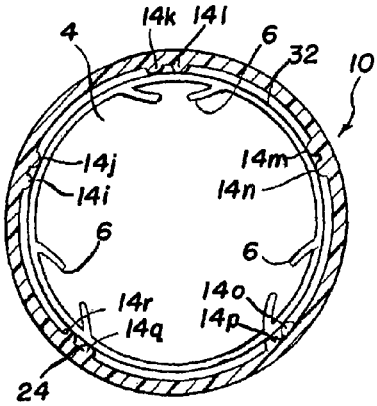
FIG. 4 is a cross-sectional view of an embodiment of the present invention from a view along line 3-3.

FIG. 4 is a cross-section of FIG. 1 taken along a line 3-3 depicting an alternate embodiment. As seen in FIG. 4 the number of vertical ribs can be varied. In FIG. 4, vertical ribs 14*i-r* are arranged in pairs on the interior wall 24 of the lower cylindrical enclosure 10. Like FIG. 3, each pair of vertical ribs is comprised of a first vertical rib and a second vertical rib such that the distance between the first vertical rib and the second vertical rib can be less than the distance between the first vertical rib and any other plurality of vertical ribs and can also be less than the distance between the second vertical rib and any other plurality of vertical ribs. Thus, vertical ribs 14*i* and 14*j*, 14*k* and 14*l*, 14*m* and 14*n*, 14*o* and 14*p*, and 14*q* and 14*r*, form five pairs of vertical ribs. Furthermore, each pair of vertical ribs can be substantially evenly spaced out on the interior wall of the lower cylindrical enclosure 10.

Figure 5:
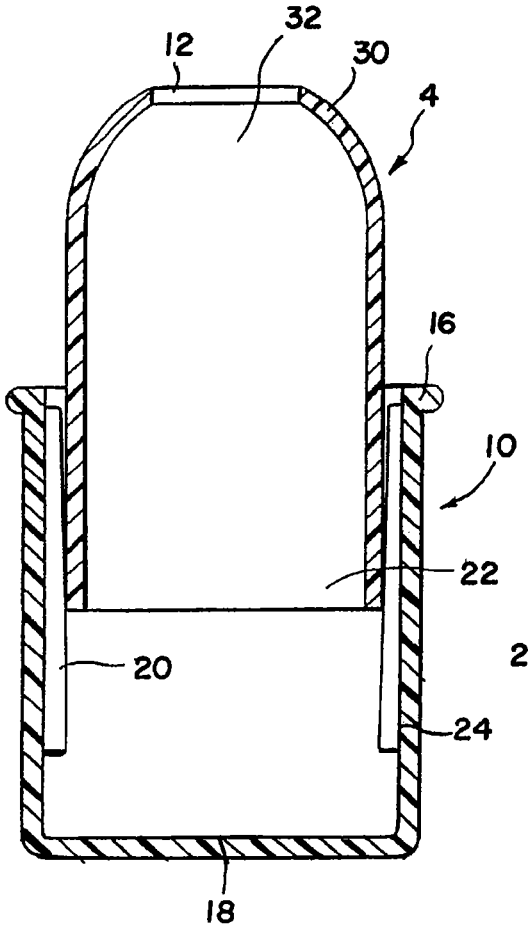
FIG. 5 is a cross-sectional view of the embodiment shown in FIG. 1 without shims.
Figure 6:
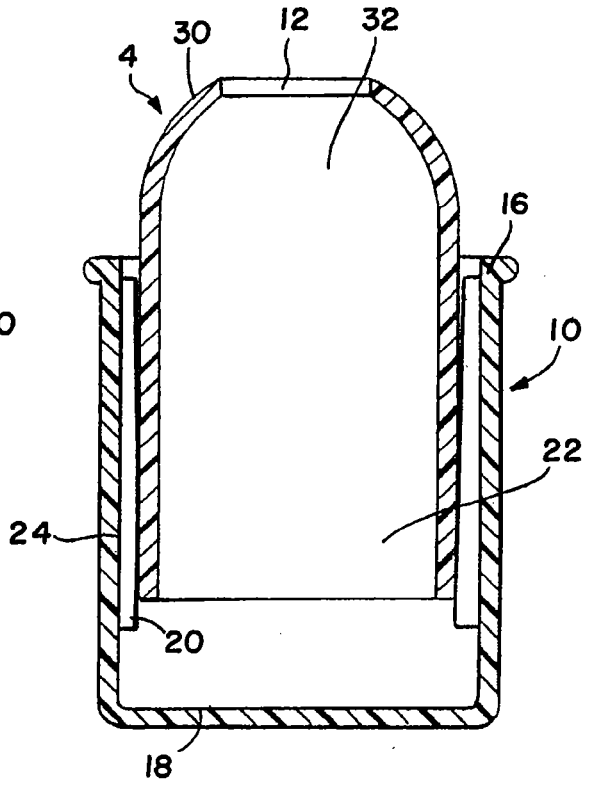
FIG. 6 is a cross-sectional view of the embodiment shown in FIG. 1 without shims.

FIGS. 5 and 6 are cross-sectional views of FIG. 1 without shims 6 depicting an alternate embodiment. In FIGS. 5 and 6, tapered vertical ribs 20 are tapered such that they are thinner near the top portion 16 of the lower cylindrical enclosure 10 and thicker near the bottom portion 18 of the lower cylindrical enclosure 10. FIGS. 5 and 6 show the upper cylindrical enclosure 4 as it is pushed into lower cylindrical enclosure 10. As can be seen, the further upper cylindrical enclosure 4 is pushed into lower cylindrical enclosure 10, the greater the resistance upper cylindrical enclosure 4 faces from the tapered vertical ribs 20. When pushing the upper cylindrical enclosure 4 all the way into lower cylindrical enclosure 10, the upper cylindrical enclosure 4 may be slightly deformed by the tapered vertical ribs 20 while the tapered vertical ribs 20 maintain a grip on the upper cylindrical enclosure 4. Thus, when the insulating holder 28 is tilted at an angle, upper cylindrical enclosure 10 will remain substantially in place or allows a user to drink the contents of the bottle 26 or a can without worrying about the upper cylindrical enclosure 4 and the bottle 26 or can falling out of the lower cylindrical enclosure 10.

Figure 7:
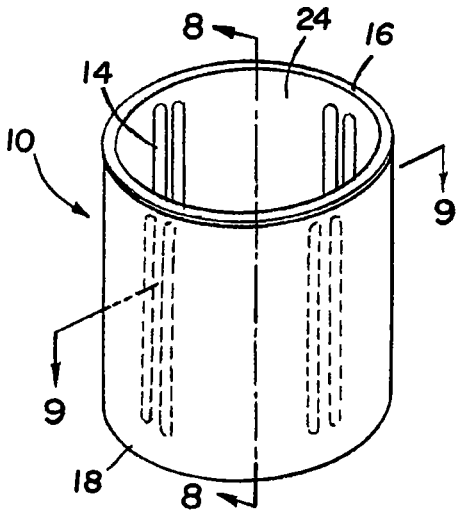
FIG. 7 is a perspective view of the embodiment shown in FIG. 1 showing only the lower cylindrical enclosure.

FIG. 7 is a perspective view of FIG. 1 without the upper cylindrical enclosure 4. Lower cylindrical enclosure 10 has a plurality of vertical ribs 14.

Figure 8:
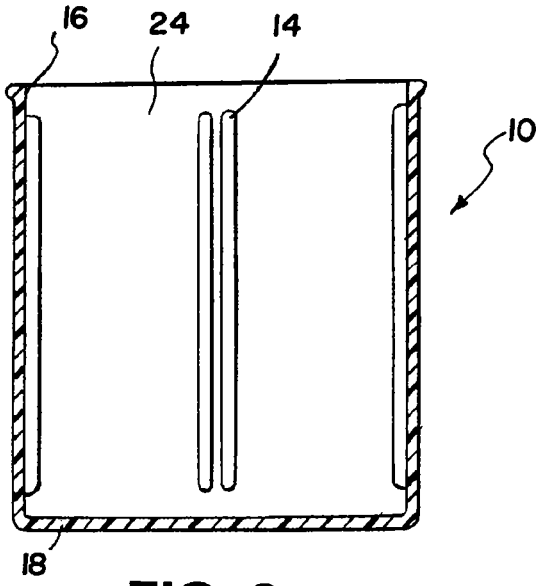
FIG. 8 is a cross-sectional view of FIG. 7 taken along a line 8-8.

FIG. 8 is a cross-section of FIG. 7 taken along a line 8-8. As can be seen in FIG. 8, the plurality of vertical ribs 14 are preferably elongated and protrude slightly from the interior wall 24 of the lower cylindrical enclosure 10.

Figure 9:
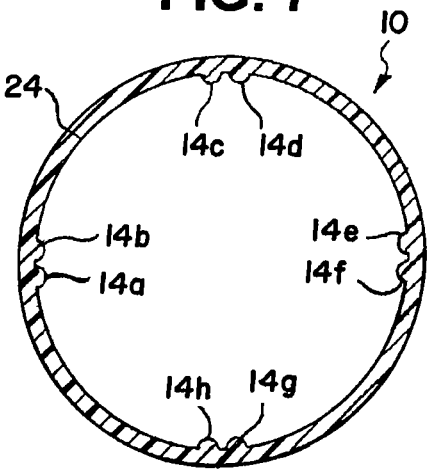
FIG. 9 is a cross-sectional view of FIG. 7 taken along a line 9-9.

FIG. 9 is a cross-section of FIG. 7 taken along a line 9-9.

Figure 10:
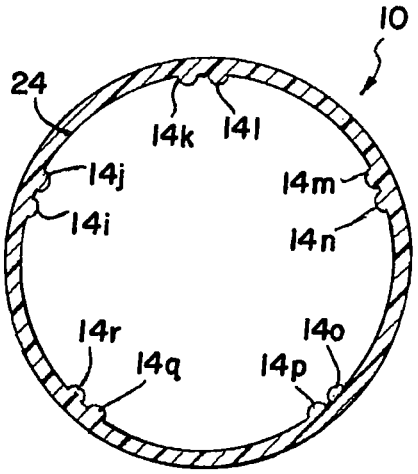
FIG. 10 is a cross-sectional view of an embodiment of the present invention from a view along line 9-9.

FIG. 10 is a cross-section of FIG. 7 taken along a line 9-9 which depicts an alternate embodiment. As can be seen in FIG. 10, vertical ribs 14*i-r* form five pairs of vertical ribs along interior wall 24 of the lower cylindrical enclosure 10.

Figure 11:
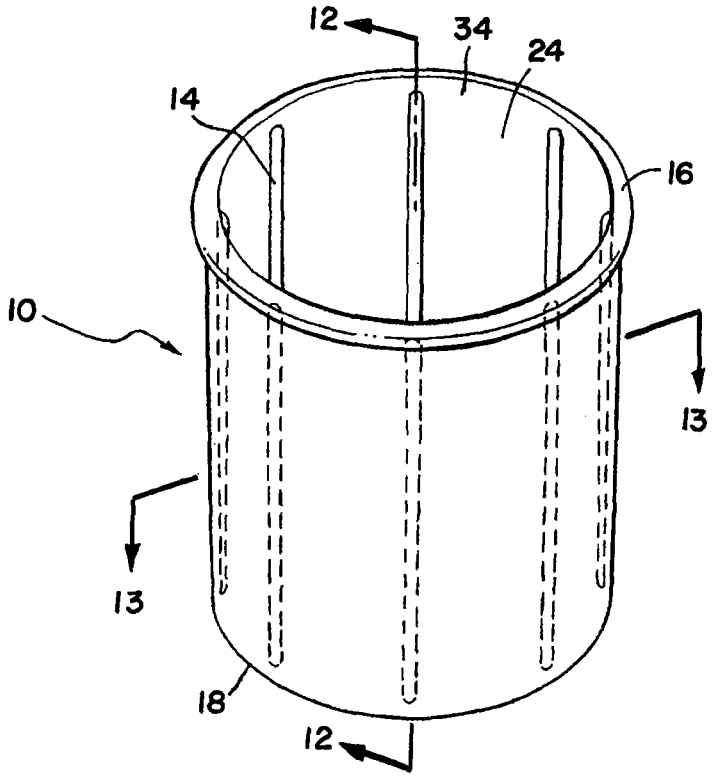
FIG. 11 is a perspective view of an embodiment of a lower cylinder.

FIG. 11 is a perspective view of an alternate embodiment of the invention. FIG. 11 has a cylindrical recess 34 in the interior wall 24 around a top portion 16 of the lower cylindrical enclosure 10. The cylindrical recess 34 is configured so that the diameter of the interior wall 24 at the cylindrical recess 34 is greater than the diameter of the interior wall 24 at all other locations of the lower cylindrical enclosure 10. The cylindrical recess 34 is designed to facilitate insertion of an upper cylindrical enclosure 4 into the lower cylindrical enclosure 10 by an unobservant user.

FIG. 11 also depicts the use of 8 vertical ribs substantially evenly spaced along the interior wall of the lower cylindrical enclosure 10. The advantage of having the vertical ribs evenly spaced along the interior wall is that tolerance variations inherent in the manufacturing process for these parts by different manufacturers will not affect the snug fit expected between the upper cylindrical enclosure 4 and lower cylindrical enclosure 10.

Figure 12:
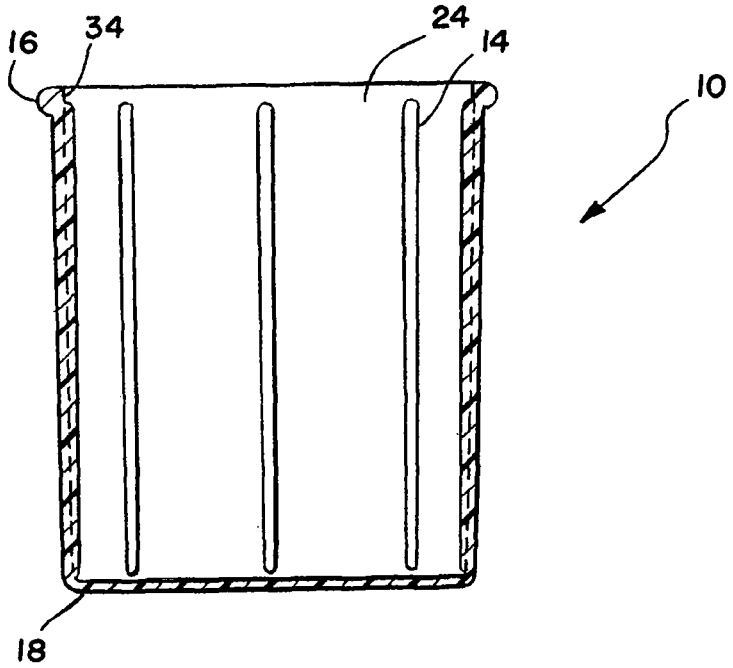
FIG. 12 is a cross-sectional view of FIG. 11 taken along a line 12-12.

FIG. 12 is a cross-section of the lower cylindrical enclosure 10 of FIG. 11, taken along a line 12-12. FIG. 12 more clearly illustrates the cylindrical recess 34 in the interior wall 24 around a top rim 16 of the lower cylindrical enclosure 10.

Figure 13:
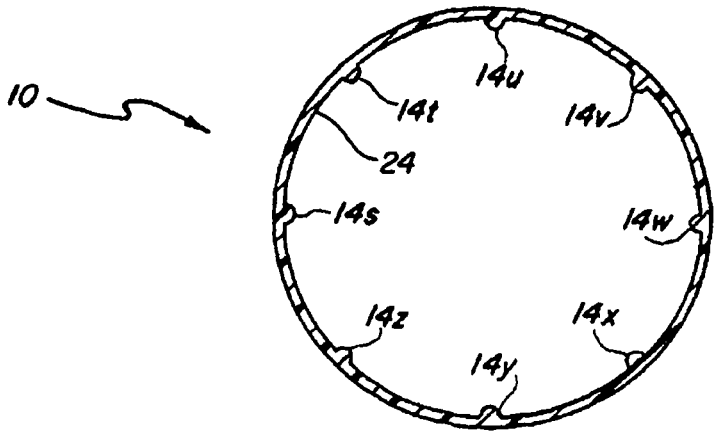
FIG. 13 is a cross-sectional view of FIG. 11 taken along a line 13-13.

FIG. 13 is a cross-section of the lower cylindrical enclosure 10 of FIG. 11, taken along a line 13-13. FIG. 13 more clearly illustrates the 8 vertical ribs 14*s-z* substantially evenly spaced around the interior wall 24 of the lower cylindrical enclosure 10.

FIG. 14 illustrates a cross-section view of the upper cylindrical enclosure 4 inserted into the lower cylindrical enclosure 10 with the dome-shaped end 30 of the upper cylindrical enclosure 4 inserted first. In this configuration, the upper cylindrical enclosure 4 is configured to receive a can inserted through the second circular rim end 22. The shims 6 grip the can to hold it in place.

Figure 15:
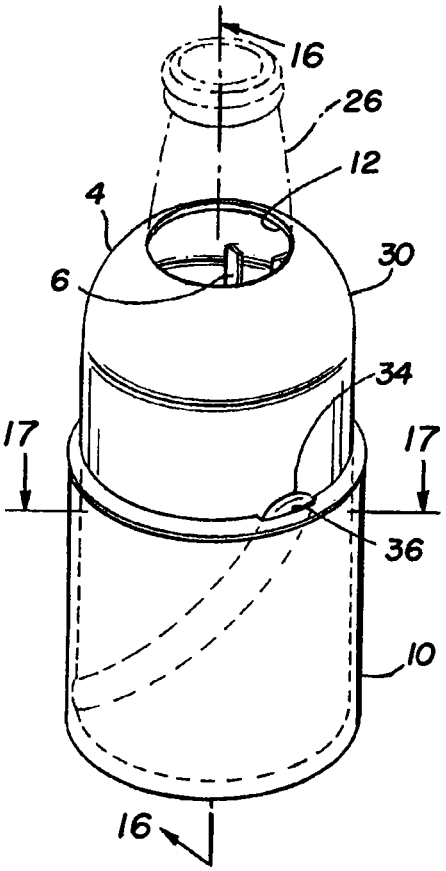
FIG. 15 is a perspective view of an embodiment of the present invention.

FIG. 15 illustrates an embodiment of an insulating holder including a male/female thread arrangement 34/36 formed on the exterior surface of the upper cylindrical enclosure 4 and the inside of the lower cylindrical enclosure 10. The thread arrangement includes first thread means 36 and second thread means 34. The male/female thread arrangement 34/36 guides the insertion of the upper cylindrical enclosure 4 into the lower cylindrical enclosure 10.

Figure 23:
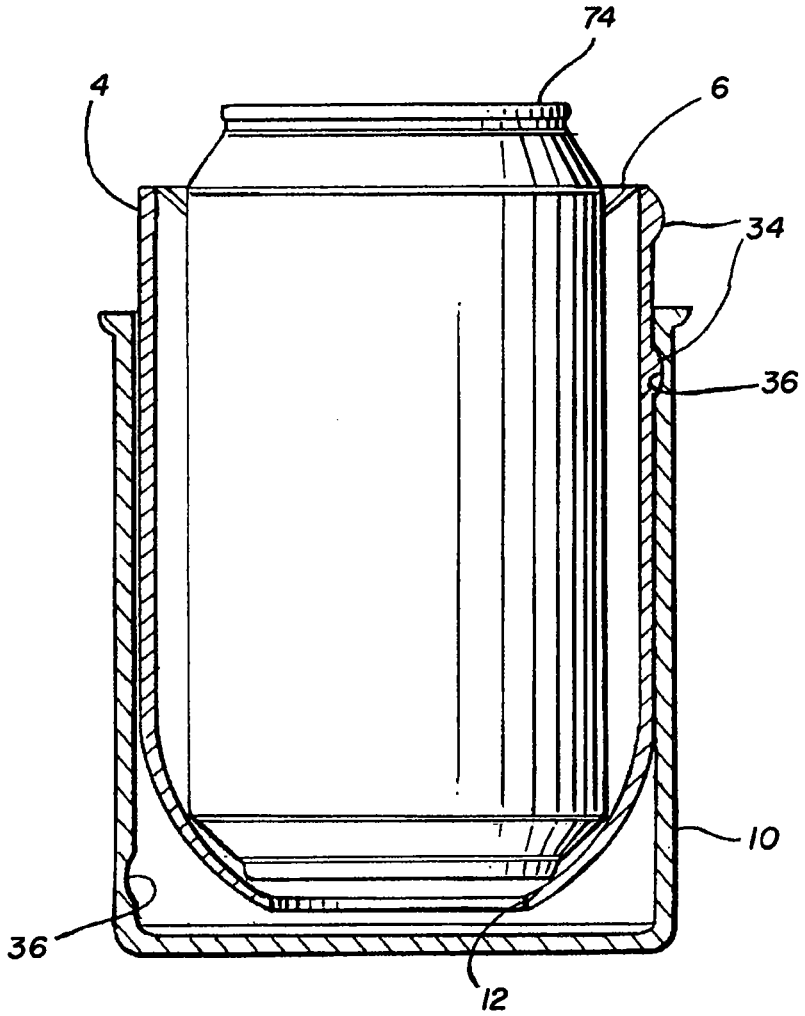
FIG. 23 is a cross-sectional view of the upper and lower enclosures engaged to hold a can, the upper enclosure being reversed from the orientation shown in FIG. 16.

The first thread means 36 located on the inside of the lower cylindrical enclosure 10 and the second thread means 34 formed on the lower portion of the exterior surface of the upper cylindrical enclosure 4 are constructed so that the upper enclosure 4 can be inserted into the lower cylindrical enclosure 10 with the second circular rim end of the upper enclosure 4 going into the lower cylindrical enclosure 10 first, as shown in FIG. 15, or with the first dome-shaped end of the upper enclosure 4 going into the lower cylindrical enclosure 10 first, as shown in FIG. 23.

Figure 16:
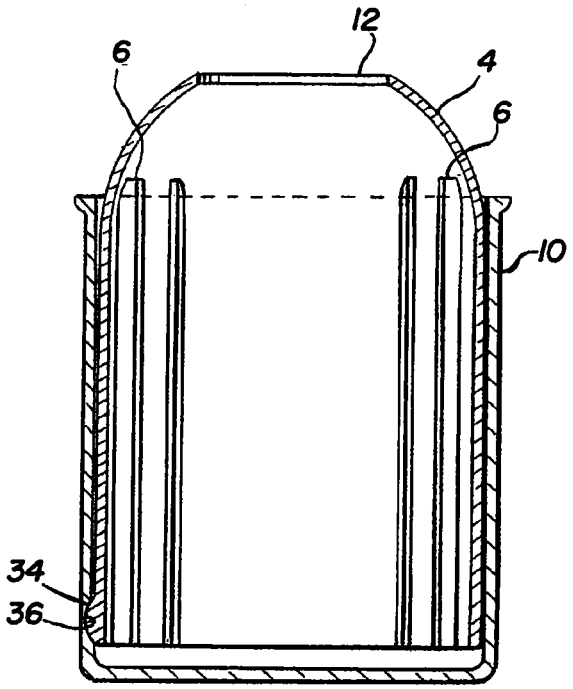
FIG. 16 is a cross-sectional view of FIG. 15 taken along line 16-16.
Figure 17:
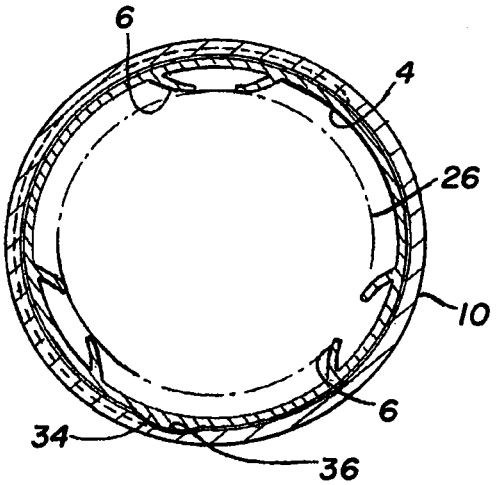
FIG. 17 is a cross-sectional view of FIG. 15 taken along line 17-17.

With the first dome-shaped end of upper cylindrical enclosure 4 being inserted into the lower cylindrical enclosure 10, as shown in FIG. 23, a canned beverage container 74 may be firmly held within the interior of the upper cylindrical enclosure by the shims 6 which extend from the circular rim second end of the upper cylindrical enclosure 4 to the start of the dome-shaped first end of upper cylindrical enclosure 4, as more clearly shown in FIG. 16.

By this construction, the insulating holder of the present invention, as illustrated in FIGS. 15, 16, 17 and 23, can be used to hold the bottle 26 by having the upper cylindrical enclosure 4 inserted into the lower cylindrical enclosure 10 in one direction and hold a can 74 by reversing the direction of insertion of the upper cylindrical enclosure 4 into the lower cylindrical enclosure 10.

Other means of retaining the upper cylindrical enclosure 4 and the lower cylindrical enclosure 10, other than the first and second thread means illustrated in FIGS. 15, 16, 17 and 23, may be utilized to advantage in the present invention.

Figure 18:
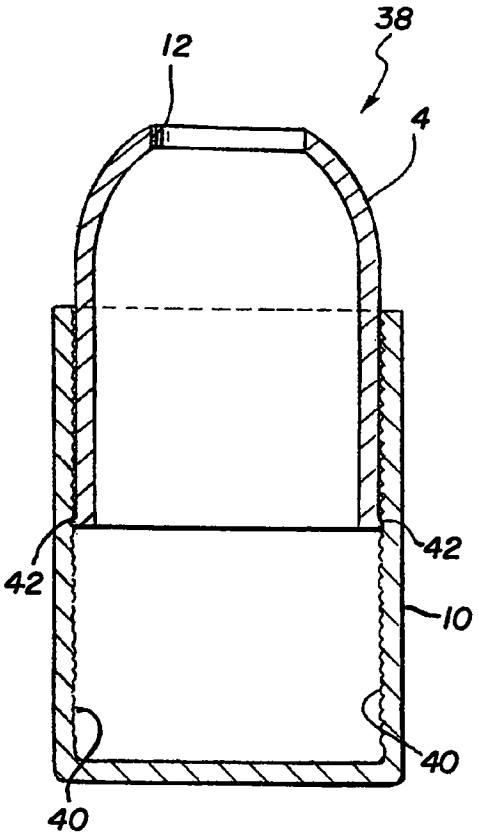
FIG. 18 is a cross-sectional view of an embodiment of the present invention from a view along line 16-16.

FIG. 18 illustrates an alternate preferred structure 38 for engagement between the upper cylindrical enclosure 4 and the lower cylindrical enclosure 10. The structure is a plurality of circumferential grooves, a first series of circumferential grooves 40 located on the inside of the lower cylindrical enclosure 10. A circumferential ridge 42 located at the second circular rim of the upper cylindrical enclosure 4 is adapted to engage with the circumferential grooves 40 and hold the upper cylindrical enclosure 4 in place, once inserted into lower cylindrical enclosure 10.

Figure 19:
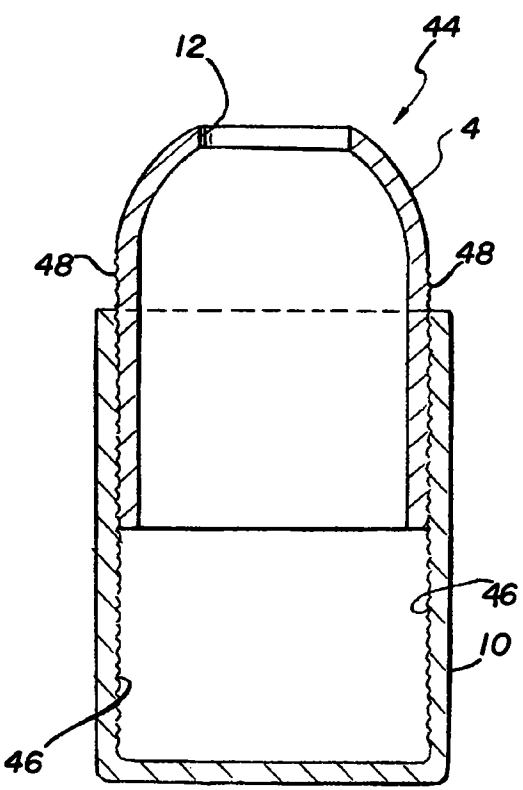
FIG. 19 is a cross-sectional view of an embodiment of the present invention from a view along line 16-16.

Another alternate embodiment 44 illustrated in FIG. 19 utilizes a first series of circumferential grooves 46 on the inside of lower cylindrical enclosure 10 and a second series of circumferential grooves 48 on the lower portion of the exterior surface of the upper cylindrical enclosure 4. The first series of circumferential grooves 46 on the inside of the lower cylindrical enclosure 10 and the second series of circumferential grooves 48 on the outside of upper cylindrical enclosure 4, which may start at the circular rim second end and extend as far as the start of the domed portion of upper cylindrical enclosure 4, engage each other to hold the upper cylindrical enclosure 4 within lower cylindrical enclosure 10.

Figure 20:
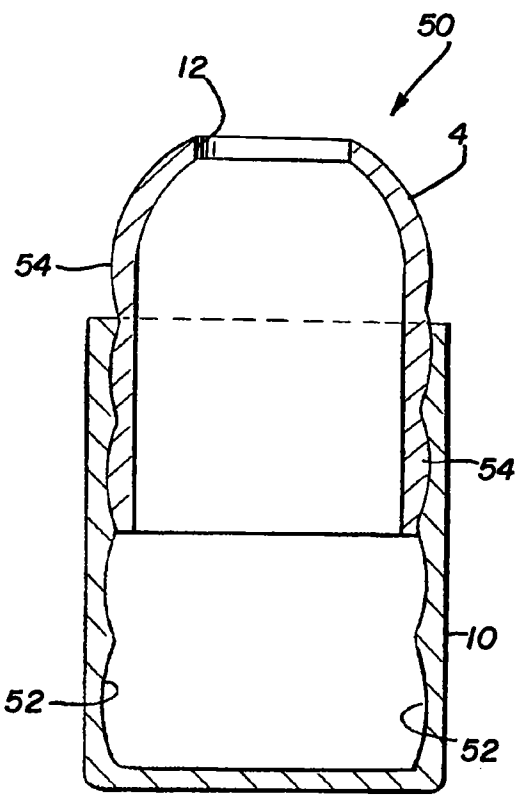
FIG. 20 is a cross-sectional view of an embodiment of the present invention from a view along line 16-16.

Another alternate embodiment 50 illustrated in FIG. 20 utilizes a first series of circumferential undulations 52 on the inside of the lower cylindrical enclosure 10. A second series of circumferential undulations 54 are located on the lower portion of the exterior surface of upper cylindrical enclosure 4, preferably extending from the circular rim second end of upper cylindrical enclosure 4 close to the start of the domed-shaped first end of upper cylindrical enclosure 4.

Figure 21:
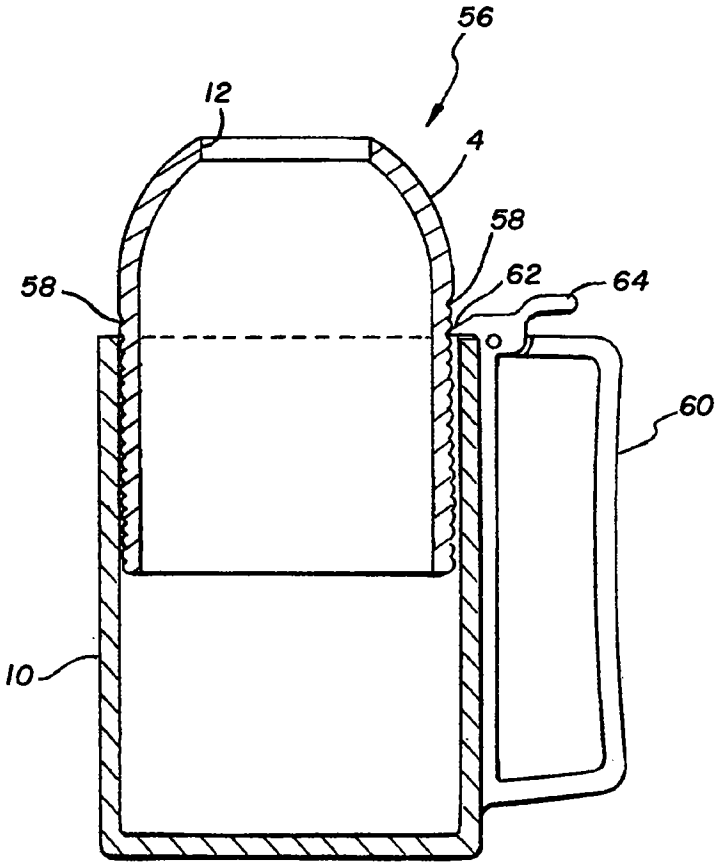
FIG. 21 is a cross-sectional view of an embodiment of the present invention from a view along line 16-16.

Yet another embodiment 56 is illustrated in FIG. 21. This embodiment utilizes a handle 60 mounted to the outside surface of the lower cylindrical enclosure 10 by an adhesive, for example. Handle 60 has a latch 64 which pivots with respect to handle 60 so that the engagement edge 62 of latch 64 makes contact with a series of circumferential grooves 58 formed on the lower portion of the exterior surface of upper cylindrical enclosure 4 when upper cylindrical enclosure 4 is inserted into lower cylindrical enclosure 10. The latch 64, by way of its engaging edge 62, maintains upper cylindrical enclosure 4 within lower cylindrical enclosure 10.

Figure 22:
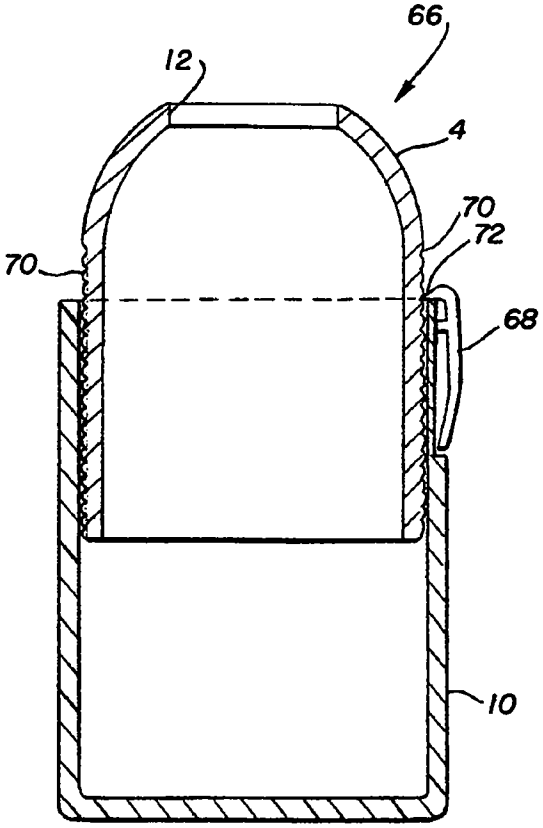
FIG. 22 is a cross-sectional view of an embodiment of the present invention from a view along line 16-16.

Another alternate embodiment 66 is illustrated in FIG. 22. Here, the lower cylindrical enclosure 10 has a latch mechanism 68 attached thereto by way of adhesive or other convenient means. Latch mechanism 68 has engaging edge 72, which engages a series of circumferential grooves 70 formed on the lower portion of the exterior surface of upper cylindrical enclosure 4. Latch 68 thus maintains upper cylindrical enclosure 4 within lower cylindrical enclosure 10 once inserted therein.

Figure 24:
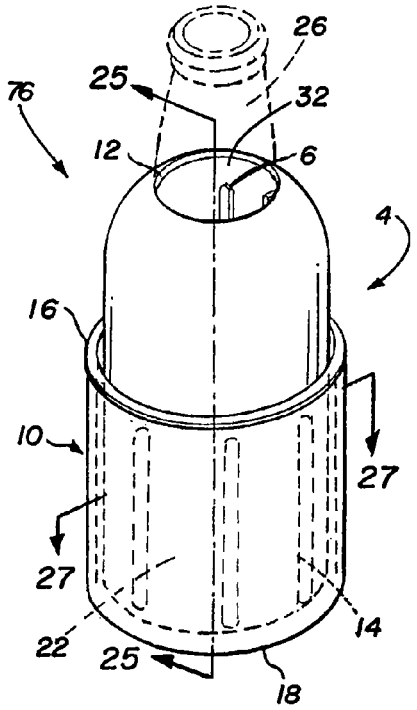
FIG. 24 is a perspective view of an embodiment of the present invention.
Figure 25:
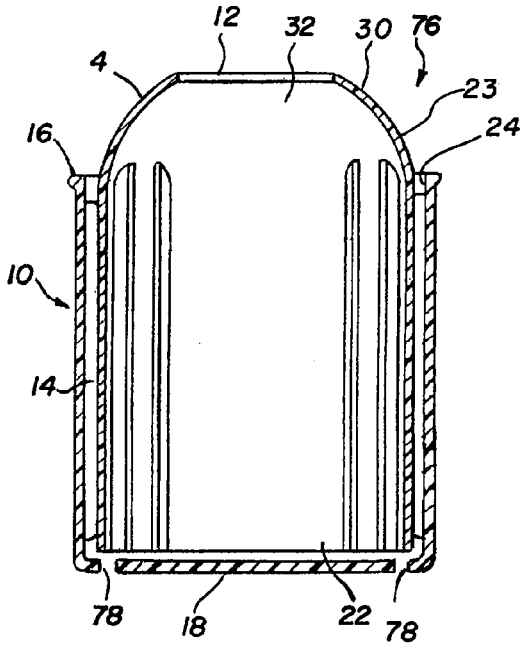
FIG. 25 is a cross-sectional view of FIG. 24 taken along line 25-25.

FIGS. 24-25 illustrate an embodiment of an insulating holder 76 including air vent holes 78 at the bottom 18 of the lower cylindrical enclosure 10. FIG. 25 shows a cross sectional view of the insulating holder 76 shown in FIG. 24, along line 25-25, with the air vent holes 78 visible. The air vent holes 78 allow air to escape from the interior of the insulating holder 76 when the upper cylindrical enclosure 4 is inserted into the lower cylindrical enclosure 10. The air vent holes 78 also allow air to pass into the interior of the insulating holder 76 when the upper cylindrical enclosure 4 is slid out from the lower cylindrical enclosure 10. The air vent holes 78 thus improve the ability of the upper cylindrical enclosure 4 to slide within the lower cylindrical enclosure 10.

Figure 26:
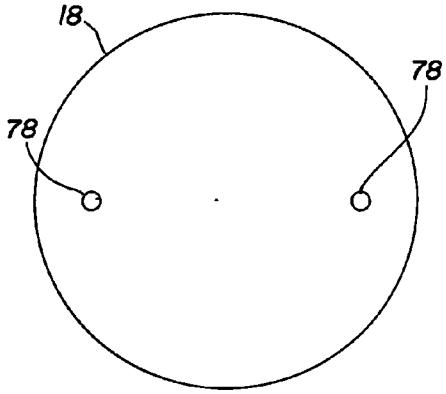
FIG. 26 is a bottom view of the embodiment of the present invention shown in FIG. 24.
Figure 27:
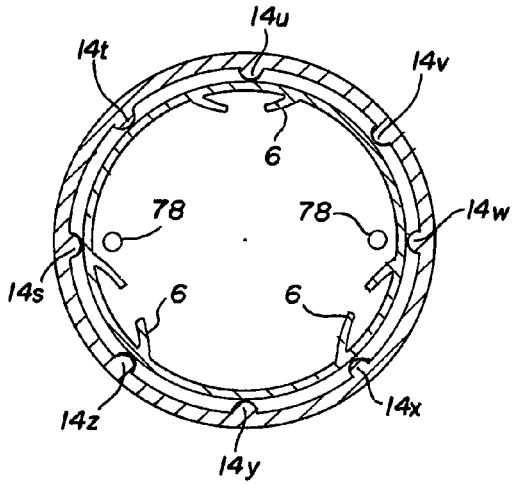
FIG. 27 is a cross-sectional view of FIG. 24 taken along line 27-27.

FIG. 26 illustrates a bottom view of the insulating holder 76, showing the air vent holes 78. FIG. 27 illustrates a cross section view of the insulating holder 76, taken along line 27-27, and showing the air vent holes 78. Although the air vent holes 78 are shown as two holes positioned at the edge of the insulating holder's bottom 18, any number of air vent holes 78 may be used and variably positioned as desired in other embodiments.

Figure 28:
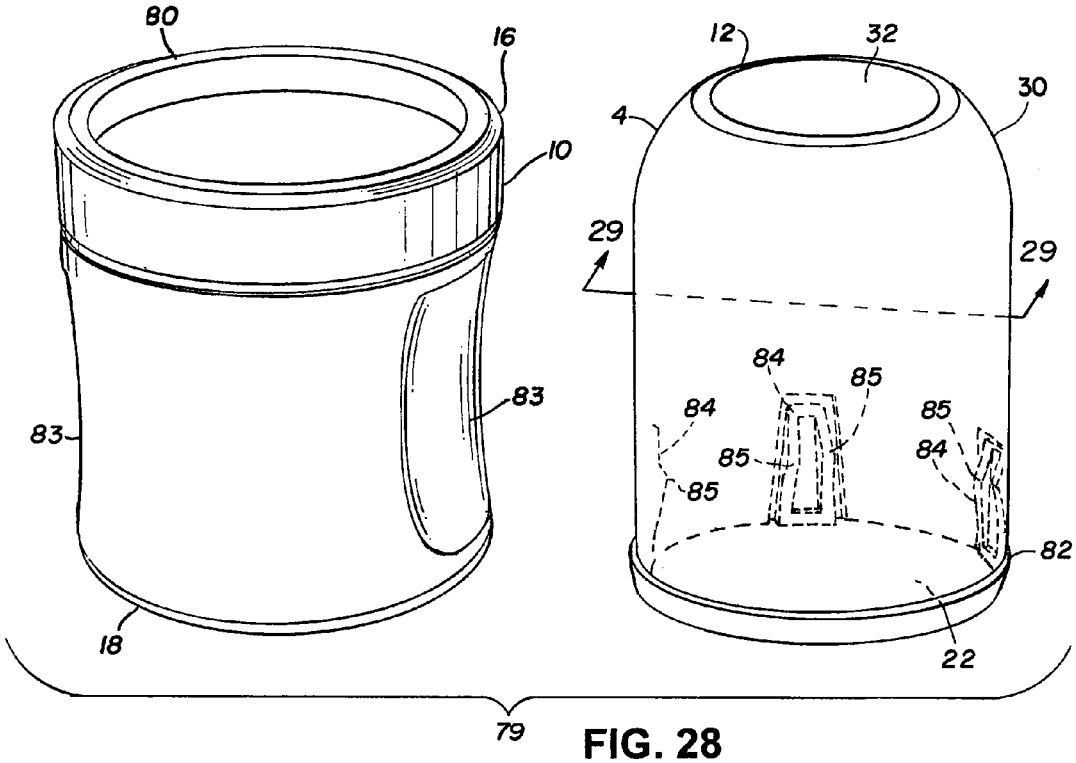
FIG. 28 is a perspective view of an embodiment of the present invention.

FIG. 28 illustrates an embodiment of an insulating holder 79 including indentations 83 along the exterior wall of the lower cylindrical enclosure 10. The indentations 83 form hand grips for a user to grip when using the insulating holder 79. The hand grips prevent the lower cylindrical enclosure 10 from easily sliding out of the user's hand.

FIG. 28 also illustrates a catch 80 along an interior surface of the lower cylindrical enclosure 10. The catch 80 comprises a flange extending towards the interior of the lower cylindrical enclosure 10. The catch 80 extends circumferentially around the interior of the lower cylindrical enclosure 10. The catch 80 is shaped to mate with a lip 82 at the rim end 22 of the upper cylindrical enclosure 4. The lip 82 comprises a flange that extends out from the upper cylindrical enclosure 4, and extends circumferentially around the exterior of the upper cylindrical enclosure 4. The lip 82 catches against the catch 80 to prevent the upper cylindrical enclosure 4 from easily exiting the lower cylindrical enclosure 10. The lip 82 and catch 80 may be made of flexible material, however, to allow the lip 82 to disengage from the catch 80 if sufficient force is applied.

FIG. 28 additionally illustrates ribs 84 of the upper cylindrical enclosure 4 that extend about a quarter of the total length of the upper cylindrical enclosure 4. The ribs 84 are positioned along the interior of the upper cylindrical enclosure 4 in spaced pairs of two. The ribs 84 include bumps 85 shaped to contact a bottle or can, to hold the bottle or can in position within the upper cylindrical enclosure 4. The bumps 85 retain the bottle or can in position, yet provide reduced friction against the bottle or can when it is inserted into the upper cylindrical enclosure 4.

Figure 29:
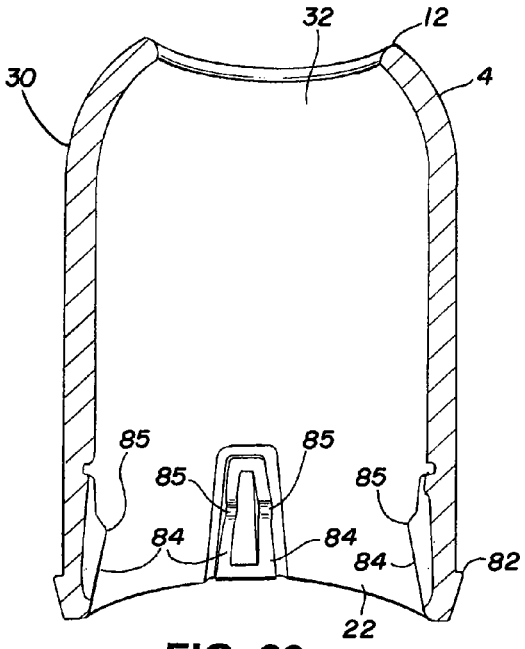
FIG. 29 is a perspective view of the upper cylindrical enclosure shown in FIG. 28 taken along line 29-29.

FIG. 29 illustrates a side cross section view of the upper cylindrical enclosure 4 along line 29-29, illustrating the lip 82 extending out from the upper cylindrical enclosure 4. FIG. 29 additionally illustrates the bumps 85 extending towards the interior of the upper cylindrical enclosure 4.

Figure 30:
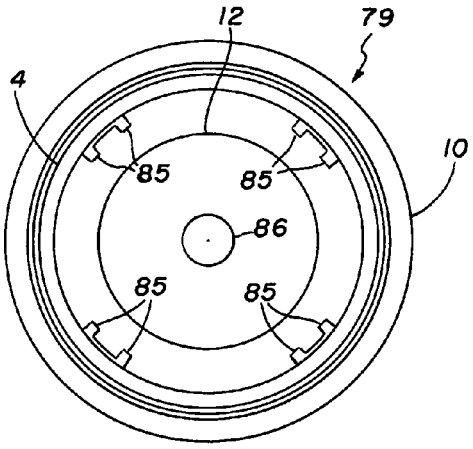
FIG. 30 is a top view of the embodiment shown in FIG. 28, with the upper cylindrical enclosure shown in FIG. 28 inserted into the lower cylindrical enclosure shown in FIG. 28, with the dome-shaped end of the upper cylindrical enclosure inserted first.

FIG. 30 illustrates a top view of the insulating holder 79 with the upper cylindrical enclosure 4 inserted into the lower cylindrical enclosure 10, with the circular opening 12 inserted first. An air vent hole 86 is shown at the bottom of the lower cylindrical housing 10. The bumps 85 are shown extending towards the interior of the upper cylindrical enclosure 4.

FIG. 31 illustrates a side cross section view of the insulating holder 79 with the upper cylindrical enclosure 4 inserted into the lower cylindrical enclosure 10, with the circular rim end 22 inserted first. The insulating holder 79 is shown retaining a bottle 26 therein. The orientation of the catch 80 relative to the lip 82 is shown. The lip 82 extends outward, to contact the catch 80 if the upper cylindrical enclosure 4 were slid out from the lower cylindrical enclosure 10. Additional force may push the lip 82 past the catch 80, to allow the upper cylindrical enclosure 4 to disengage from the lower cylindrical enclosure 10.

The orientation of the lip 82 and the catch 80 produces an air pocket 89 that enhances the insulation properties of the insulating holder 79. As shown in FIG. 31, the lip 82 extends outward from the upper cylindrical enclosure 4 and the catch 80 extends inward from the lower cylindrical enclosure 10, which forms an air pocket 89 between the walls of the upper and lower cylindrical enclosures 4, 10. The air pocket 89 reduces the amount of cool air that may escape from the insulating holder 79, thus keeping the bottle 26 colder for longer.

The insulating holder 79 further reduces the amount of cool air that may escape because of the contact area 92 between the shoulder 81 of the bottle 26 and the dome-shaped first end 30 of the upper cylindrical enclosure 4. The contact area 92 is formed because the upper cylindrical enclosure 4 presses against the shoulder 81 of the bottle 26. The contact area 92 forms a seal against the shoulder 81 of the bottle 26 that creates an air pocket 88 between the bottle 26 and the interior wall of the upper cylindrical enclosure 4. The cool air contained within the air pocket 88 cannot easily escape from the insulating holder 79 through the contact area 92.

In addition, the insulating holder 79 includes an indentation 87 in its bottom 18 that creates a contact area 91 between the bottom rim of the bottle 26 and the bottom 18 of the lower cylindrical enclosure 10. The cool air contained within the air pocket 88 cannot easily escape from the insulating holder 79 through the contact area 91, thus keeping the bottle 26 colder for longer. In addition, a gap 90 may be formed at the bottom of the bottle 26 for air to be trapped therein. However, in the embodiment shown in FIG. 31, an air vent hole 86 may allow air to escape from the gap 90. In other embodiments, the air vent hole 86 may be repositioned or eliminated.

Figure 32:
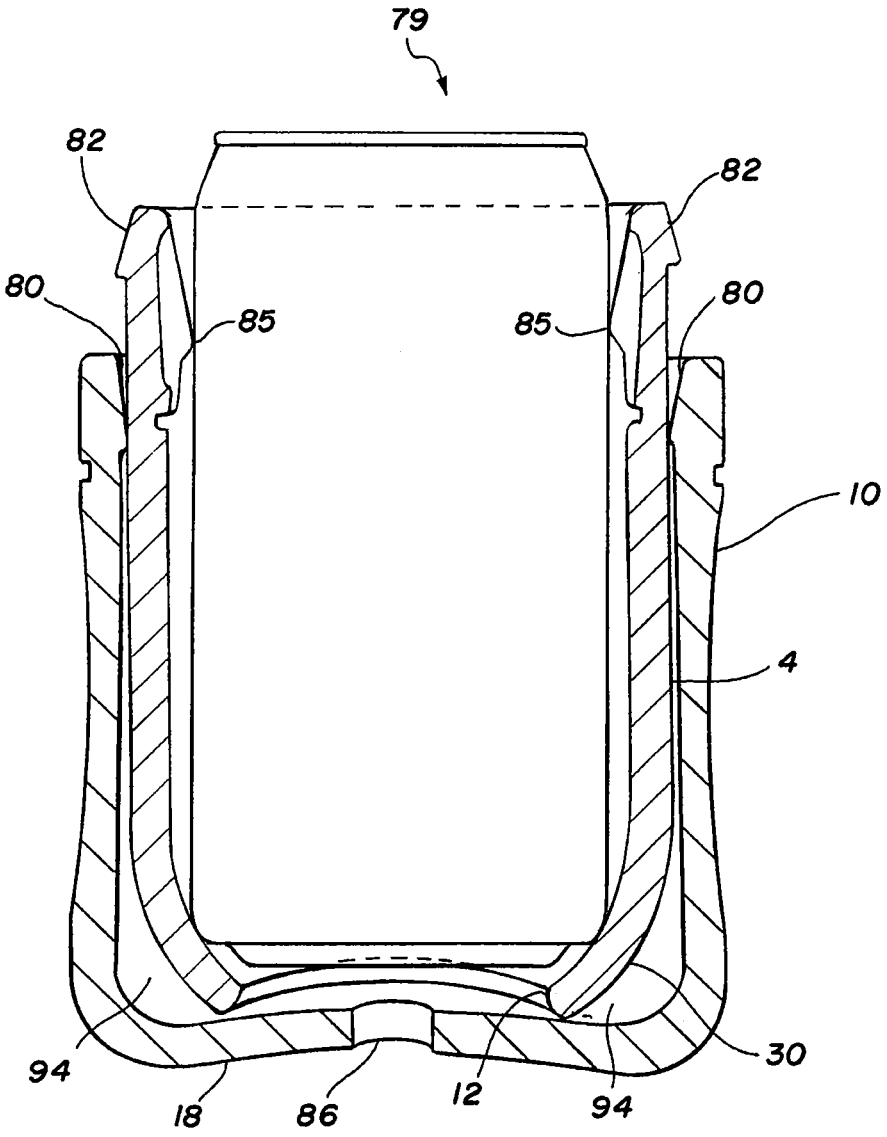
FIG. 32 is a cross-sectional view of the embodiment shown in FIG. 28, with the upper cylindrical enclosure inserted into the lower cylindrical enclosure with the dome-shaped end of the upper cylindrical enclosure inserted first.

FIG. 32 illustrates a side cross section view of the insulating holder 79 with the upper cylindrical enclosure 4 inserted into the lower cylindrical enclosure 10, with the dome-shaped first end 30 inserted first. The insulating holder 79 is shown retaining a can 74 therein. The orientation of the upper cylindrical enclosure 4 within the lower cylindrical enclosure 10 produces an air pocket 94 that enhances the insulation properties of the insulating holder 79. To form the air pocket 94, the catch 80 of the lower cylindrical enclosure 10 presses against the outer surface of the upper cylindrical enclosure 4. In addition, the circular opening 12 of the dome-shaped first end 30 presses against the bottom 18 of the lower cylindrical enclosure 10. The relative orientation of the catch 80 and the circular opening 12 forms the air pocket 94, which retains cold air and thus keeps the can 74 colder for longer.

The ability of the insulating holder 79 to form insulating air pockets is improved through the use of the preferred polyolefin elastomer foam material. The polyolefin elastomer foam material enhances the tightness of the seals forming the air pockets 88, 89, 90, 94 shown in FIGS. 31 and 32.

The embodiments 38, 44, 50, 56, 66, 76, and 79 described above with respect to FIGS. 18-22 and 24-32 are all capable of functioning to hold either a bottle or a can while maintaining the temperature of the beverages contained therein, as described above. When a bottle is to be held by the insulating holder, the upper cylindrical enclosure 4 is inserted into the lower cylindrical enclosure 10 over the bottle with the circular rim second end of upper cylindrical enclosure 4 inserted first. When a can is to be held by the insulating holder, the upper cylindrical enclosure 4 is inserted into the lower cylindrical enclosure 10 with the first dome-shaped end of upper cylindrical enclosure 4 inserted first.

Figure 33:
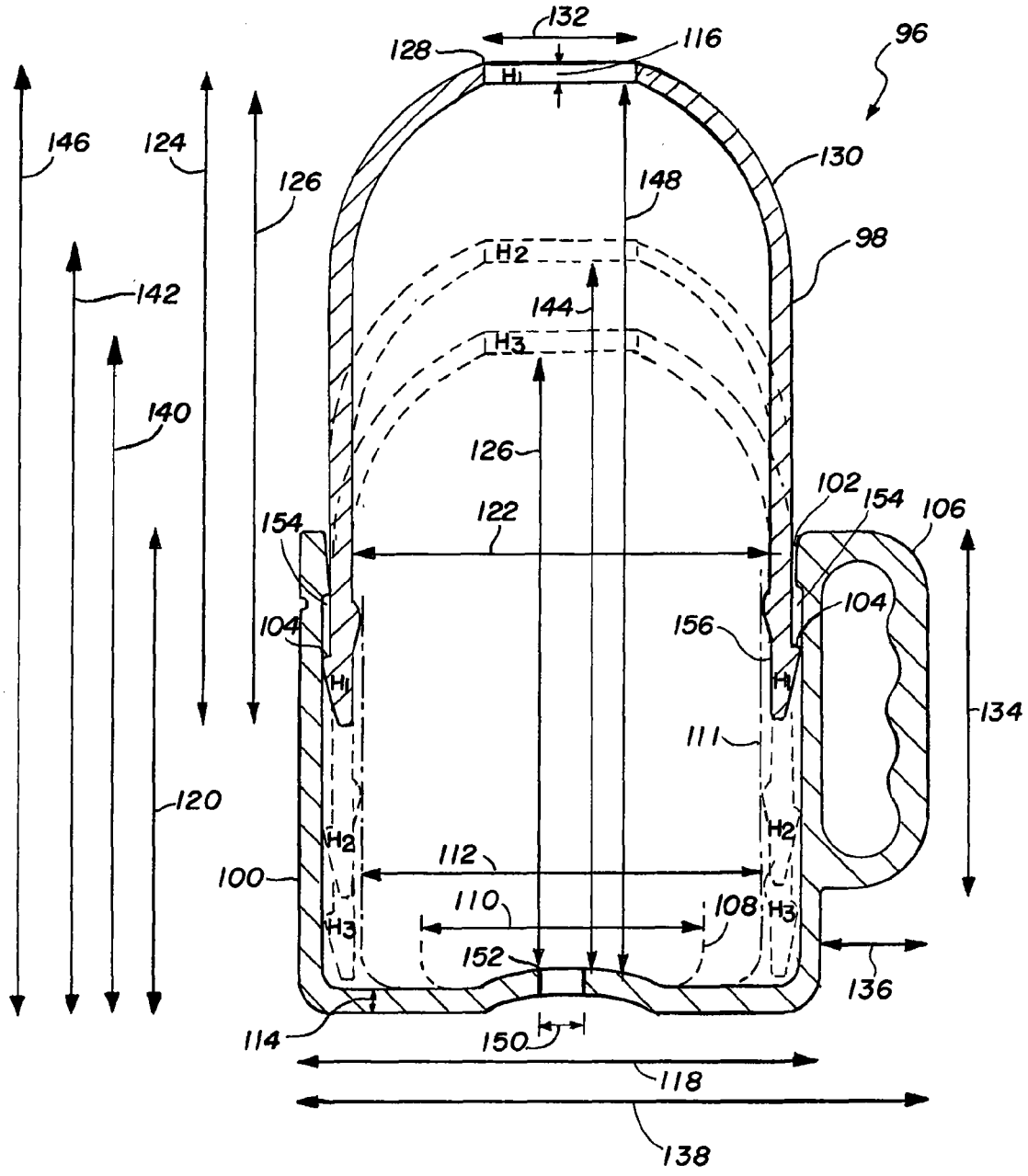
FIG. 33 is a cross-section view of an embodiment of the present invention.

FIG. 33 illustrates an embodiment of an insulating holder 96 dimensioned to retain a variety of wine bottle sizes. A side cross section view is shown, illustrating dimensions of the holder 96. The upper cylindrical enclosure 98 and the lower cylindrical enclosure 100 are shaped similar to the upper cylindrical enclosure 4 and lower cylindrical enclosure 10 shown in FIG. 28. However, the insulating holder 96 is structured more robust than other insulating holder embodiments disclosed in this application, to securely retain a wine bottle therein. The holder's 96 structure includes a large sized catch 102 designed to securely engage a large lip 104, to account for the additional weight exerted by a wine bottle against the holder 96. The insulating holder 96 is additionally structured with dimensions designed to accommodate the additional weight and size of a variety of wine bottle sizes. The dimensions allow a wine bottle of between about 750 milliliters, or a "standard" size, to be contained therein, as well as a 1.5 liter, or "magnum" size, wine bottle to be contained therein. An abbreviated outline of the relative size of a "standard" wine bottle is marked as 108. An abbreviated outline of the relative size of a "magnum" wine bottle is marked as 111. A "standard" wine bottle typically has a diameter 110 of approximately 3 inches. A "magnum" wine bottle typically has a diameter 112 of approximately 4.25 inches. The insulating holder 96 is dimensioned to allow both bottles to be contained in the same holder 96.

To accommodate this range of wine bottle sizes, the insulating holder includes walls of the lower cylindrical enclosure 100 and the upper cylindrical enclosure 98 each with a thickness 114, 116 between approximately 0.25 to 0.5 inches. Preferably, the thickness 114, 116 is approximately 0.25 inches. In addition, the lower cylindrical enclosure 100 has a diameter 118 of between approximately 5.25 inches and 6 inches.

Preferably the diameter 118 is approximately 5.5 inches. The lower cylindrical enclosure 100 has a height 120 of between approximately 5 inches and 6 inches. Preferably the height 120 is approximately 5.25 inches.

The upper cylindrical enclosure 98 has an inner diameter 122 of between approximately 4.25 and 4.75 inches. Preferably the inner diameter 122 is approximately 4.375 inches. The upper cylindrical enclosure 98 has a height 124 of between approximately 6.75 and 7.25 inches. Preferably the height 124 is approximately 7.125 inches. The height 126 of the upper cylindrical enclosure 98 not including the thickness 116 of the upper cylindrical enclosure 98 is between approximately 6.25 inches and 7 inches. The height 126 not including the thickness 116 is preferably approximately 6.875 inches. The circular opening 128 at the dome-shaped first end 130 has a diameter 132 between approximately 1.25 and 2 inches. Preferably the diameter 132 is 1.75 inches.

The handle 106 has a height 134 between approximately 3.5 and 4.25 inches. Preferably, the height 134 is approximately 3.875 inches. The handle 106 extends outward from the outer surface of the lower cylindrical enclosure 100 at a distance 136 of between approximately 1.25 and 1.5 inches. Preferably, the distance 136 is approximately 1.375 inches. A total diameter 138 of the lower cylindrical enclosure 100 and the handle 136 is between approximately 6.5 and 7.5 inches. Preferably, the total diameter 138 is approximately 6.625 inches.

The upper cylindrical enclosure 98 is capable of sliding telescopically within the lower cylindrical enclosure 100. At the lowest height of the upper cylindrical enclosure 98 (marked in outline with the designation H3) it has a height 140 above the bottom of the lower cylindrical enclosure 100 of between approximately 7 and 7.75 inches. Preferably the height 140 is approximately 7.375 inches.

The upper cylindrical enclosure 98 may be slid to a height 142 (marked in outline with the designation H2) for retaining the "standard" sized wine bottle. The height 142 of the upper cylindrical enclosure 98 above the bottom of the lower cylindrical enclosure 100 is between approximately 8.875 inches and 8 inches. Preferably the height 142 is approximately 8.375 inches. The height 144 of the upper cylindrical enclosure 98 from the base of the retained "standard" bottle, and not including the thickness 116 is between approximately 8.375 inches and 7 inches. Preferably the height 144 is approximately 7.875 inches.

The upper cylindrical enclosure 98 may also be slid to a height 146 (marked with the designation H1) for retaining the "magnum" sized wine bottle. The height 146 of the upper cylindrical enclosure 98 above the bottom of the lower cylindrical enclosure 100 is between approximately 9.75 inches and 11 inches. Preferably the height 146 is approximately 10.25 inches. The height 148 of the upper cylindrical enclosure 98 from the base of the retained "magnum" bottle, and not including the thickness 116 is between approximately 8.75 inches and 10.5 inches. Preferably the height 148 is approximately 9.75 inches.

A diameter 150 of an air vent 152 at the bottom of the lower cylindrical enclosure 100 is sized between approximately 0.25 inches and 0.5 inches. Preferably the diameter 150 is approximately 0.375 inches.

The structure of the insulating holder 96 also forms air pockets 154, similar to the air pockets 89 shown in FIG. 31. The air pockets 154 serve to enhance the insulating properties of the insulating holder 96. The air pockets 154 preferably have a width of approximately 0.0625 inches. The ability of the insulating holder 96 to form insulating air pockets is improved through the use of the preferred polyolefin elastomer foam material.

The upper enclosure 98 may be inserted into the lower cylindrical enclosure 100 with the second open end 156 first, as shown in FIG. 33, or with the circular opening 128 first, to accommodate a large can or jug within the insulating holder 96.

Those skilled in the art will appreciate that various adaptations and modifications of the just-described preferred embodiment can be configured without departing from the scope and spirit of the invention. Therefore, it is to be understood that, within the scope of the amended claims, the invention may be practiced other than as specifically described herein.

What is claimed is:

1. An insulating holder for holding either a rigid bottle having a top with a neck that increases in diameter down to a shoulder, with a larger diameter bottom half, and a bottom, or for a beverage can having a generally cylindrical diameter with a substantially fiat top and bottom, the insulating holder comprising:

a lower cylindrical enclosure having a closed first end and an open second end defining a cylindrical interior with an interior wall shaped to surround the bottom half of the rigid bottle or the bottom of the beverage can, and having a catch at the open second end extending circumferentially around the interior wall and towards the cylindrical interior;

an invertible upper cylindrical enclosure having an open first end with a diameter and defining a cylindrical interior with an outer wall facing opposite the cylindrical interior, and a dome-shaped second end with a circular opening therein sized smaller than the diameter of the open first end, and having a lip at the open first end extending circumferentially around the outer wall and away from the outer wall;

the invertible upper cylindrical enclosure structured to be inserted into the cylindrical interior of the lower cylindrical enclosure either with the dome-shaped second end inserted first to allow the beverage can to be retained within the invertible upper cylindrical enclosure and the lower cylindrical enclosure, or with the open first end inserted first to allow the neck of the rigid bottle to pass through the circular opening and have the rigid bottle from the shoulder down retained between the invertible upper cylindrical enclosure and the lower cylindrical enclosure and to cause an air pocket to be positioned between the outer wall and the interior wall that is bounded by the catch and the lip.

2. The insulating holder of claim 1, wherein the invertible upper cylindrical enclosure has an interior wall facing opposite the outer wall, and the interior wail of the lower cylindrical enclosure and the interior wall of the invertible upper cylindrical enclosure are each made of a polyolefin elastomer foam.

3. The insulating holder of claim 1, wherein the outer wall is made of the polyolefin elastomer foam.

4. The insulating holder of claim 1, wherein the invertible upper cylindrical enclosure is sized to he retained by the lower cylindrical enclosure with a friction fit after the invertible upper cylindrical enclosure is inserted into the cylindrical interior of the lower cylindrical enclosure.

5. The insulating holder of claim 1, wherein the invertible upper cylindrical enclosure is shaped such that the dome-shaped second end presses against the shoulder of the rigid bottle when the rigid bottle from the shoulder down is retained between the invertible upper cylindrical enclosure and the lower cylindrical enclosure.

6. The insulating holder of claim 1, wherein the closed first end of the lower cylindrical enclosure forms a bottom with an air vent hole to allow air flow from the cylindrical interior of the lower cylindrical enclosure to pass therethrough.

7. The insulating holder of claim 1, wherein the closed first end of the lower cylindrical enclosure forms a bottom having an indentation.

8. The insulating holder of claim 1, wherein the lower cylindrical enclosure and the invertible upper cylindrical enclosure are structured such that all portions of the rigid bottle from the shoulder down are enclosed by the lower cylindrical enclosure and the invertible upper cylindrical enclosure when the rigid bottle is retained between the invertible upper cylindrical enclosure and the lower cylindrical enclosure.

9. The insulating holder of claim 8, wherein all portions of the lower cylindrical enclosure or the invertible upper cylindrical enclosure enclosing the rigid bottle from the shoulder down, when the rigid bottle is retained between the invertible upper cylindrical enclosure and the lower cylindrical enclosure, are made of a material including a polyolefin elastomer foam.

10. The insulating holder of claim 1, wherein all portions of the lower cylindrical enclosure and the invertible upper cylindrical enclosure are made of a material including a polyolefin elastomer foam.

11. The insulating holder of claim 1, wherein the catch is an upper bound of the air pocket and the lip is a lower bound of the air pocket.

12. The insulating holder of claim 1, wherein a size of the air pocket is defined by an extent to which the open first end of the invertible upper cylindrical enclosure is inserted into the cylindrical interior of the lower cylindrical enclosure.

13. The insulting holder of claim 12, wherein the size of the air pocket increases as the open first end of the invertible upper cylindrical enclosure is further inserted into the cylindrical interior of the lower cylindrical enclosure.

14. The insulting holder of claim 1, wherein the interior wall joins the closed first end of the lower cylindrical enclosure and extends upward from the closed first end of the lower cylindrical enclosure to the open second end of the lower cylindrical enclosure, and the catch extends inwards towards the cylindrical interior of the lower cylindrical enclosure further than any other portion of the interior wall.

* * * * *